US008561922B2

(12) United States Patent
Staedtler

(10) Patent No.: US 8,561,922 B2
(45) Date of Patent: Oct. 22, 2013

(54) FAUCET AERATOR

(75) Inventor: Georg Staedtler, Bad Rodach/Gauerstadt (DE)

(73) Assignee: Neoperl GmbH, Muellheim (DE)

( * ) Notice: Subject to any disclaimer, the term of this patent is extended or adjusted under 35 U.S.C. 154(b) by 1005 days.

(21) Appl. No.: 12/580,504

(22) Filed: Oct. 16, 2009

(65) Prior Publication Data

US 2010/0102145 A1 Apr. 29, 2010

(30) Foreign Application Priority Data

Oct. 21, 2008 (DE) ..... 10 2008 052 541

(51) Int. Cl.
*E03C 1/08* (2006.01)

(52) U.S. Cl.
USPC ..... 239/428.5; 239/500; 239/518; 239/553.3; 239/590; 239/590.3

(58) Field of Classification Search
USPC ..... 239/428.5, 500, 518, 553.3, 590, 590.3, 239/396
See application file for complete search history.

(56) References Cited

U.S. PATENT DOCUMENTS

| | | | | |
|---|---|---|---|---|
| 5,495,985 | A | 3/1996 | Nehm et al. | |
| 5,769,326 | A * | 6/1998 | Muchenberger et al. | 239/428.5 |
| 6,513,731 | B2 * | 2/2003 | Griffin et al. | 239/394 |
| 7,757,969 | B2 | 7/2010 | Lacher et al. | |

FOREIGN PATENT DOCUMENTS

| | | | |
|---|---|---|---|
| DE | 201 15 636 | U1 | 2/2003 |
| DE | 10 2005 001 419 | B3 | 5/2006 |
| WO | WO 98/16695 | A1 | 4/1998 |

OTHER PUBLICATIONS

European Search Report dated Jan. 28, 2011 (Seven (7) pages).

* cited by examiner

*Primary Examiner* — Dinh Q Nguyen
(74) *Attorney, Agent, or Firm* — Crowell & Moring LLP

(57) ABSTRACT

A faucet aerator is provided with a plurality of pins oriented in a flow direction, spaced apart from one another, and extending essentially over the distance between a flow-dispersing device and an adjacent grid and/or lattice structure. The pins each have an evaporation surface, which is situated outside the region that is struck directly by the individual streams but can be wetted by the water flowing through the aerator housing and for this purpose, the pins are situated laterally outside the projection of the through-flow holes oriented in the flow direction. These comparatively long pins around which the flowing water circulates are covered by an enveloping water film even after the water valve is closed, which results in an increased humidity and therefore a reduced evaporation in the housing interior of the aerator housing. This prevents a complete drying-out of the interior of the aerator housing.

17 Claims, 6 Drawing Sheets

Pin Height h/Pin Diagonal d is greater than 1.5

FAUCET AERATOR

BACKGROUND AND SUMMARY OF THE INVENTION

The invention relates to a faucet aerator with an aerator housing whose housing interior contains a flow-dispersing device with a plurality of through-flow holes for dispersing the incoming flow of water into a corresponding number of individual streams as well as at least one grid and/or lattice structure spaced apart from it in the flow direction; in the housing subregion situated between the flow-dispersing device (3) and the adjacent grid and/or lattice structure, a plurality of pins is provided, which are oriented in the flow direction, spaced apart from one another, and extend essentially over the distance between the flow-dispersing device and the adjacent grid and/or lattice structure.

Faucet aerators, which transform the water flowing from a sanitary outflow fixture into a homogeneous, non-spattering, and optionally also bubble-softened flow of water are already known in an extremely wide variety of designs. As a rule, these faucet aerators have an aerator housing that is embodied in the form of an insert cartridge and can be inserted into the water outlet of a sanitary outflow fixture and whose housing interior has a flow-dispersing device, for example embodied in the form of a perforated plate, situated at its inflow end and at least one grid and/or lattice structure situated downstream of it in the flow direction. This at least one grid and/or lattice structure, which can be a metal sieve or can also be embodied in the form of a plastic grid, can function as a flow-regulating device that mixes air into the individual streams issuing from the flow-dispersing device. In addition to or in lieu of this, at least one grid and/or lattice structure situated downstream of the flow-dispersing device can also be embodied in the form of a flow straightener whose function is to homogenize the flow of water issuing from the water outlet.

DE 201 15 636 U1 has already disclosed a faucet aerator, which, between a water inlet opening and a water outlet opening of its aerator housing, has a flow-dispersing device and a flow-regulating device situated downstream of it in the flow direction. The flow-dispersing device, which is embodied as a perforated plate with a plurality of through-flow holes, is followed by an insert piece that has an annular wall joined to a central element by means of a plurality of radial struts. A respective annular conduit is provided on the one hand between the annular wall and the housing wall of the aerator housing and on the other hand between the annular wall and the central element of the insert piece. In a step-shaped subregion, the annular wall has a multitude of pins that are situated on it in three concentric rings. Another concentric ring of pins is provided on the central element of the insert piece. The conically tapering ends of the pins point in the direction toward the flow-dispersing device and are each struck by one of the individual streams issuing from the flow-dispersing device in such a way that the pin-ends each constitute a deflecting bevel for the individual streams issuing from the through-flow holes of the flow-dispersing device. The pins provided in the previously known faucet aerator consequently have a chiefly jet-forming action on the water flowing through and, for purposes of decelerating, dividing, and air-mixing, are intended to function as flow obstacles for the individual streams that they deflect.

U.S. Pat. No. 7,217,362 B2 has already disclosed a faucet aerator, which has a perforated plate functioning as a flow-dispersing device at its downstream end and in the region of the water outlet opening of the aerator housing, has concentric annular walls that guide the flowing water into annular conduits situated between themselves. In this instance, pyramid-shaped projections are formed onto the inflow edge of the annular walls in the region of the water outlet opening; these projections are likewise intended to decelerate, divide, and thus mix air into the individual streams issuing from the flow-dispersing device. These pyramid-shaped projections previously known from U.S. Pat. No. 7,217,362 B2 therefore have a primarily jet-forming function.

Faucet aerators have also been produced, which have a non-round aerator housing with a greater housing width in comparison to the housing depth in order to produce a flow of water that issues from the water outlet in a wide ribbon.

In the previously known faucet aerators, there is sometimes the risk that even after the water valve is closed, water remaining in the aerator housing is exposed to the ambient air, which is sometimes dry, causing this residual water in the housing interior to evaporate, leaving behind an undesirable layer of scale. Over time, an undesirable layer of scale can build up on the interior of the aerator housing and particularly in the small flow-dispersing bores of the flow-dispersing device, which subsequently impairs the functionality of this faucet aerator or worse, prevents it from functioning at all.

The object of the invention, therefore, is in particular to create a faucet aerator of the type mentioned at the beginning, which is characterized by a malfunction-free operation, even over a long period of time.

In the faucet aerator of the type mentioned at the beginning, this object is attained according to the invention in that the pins each have an evaporation surface, which is situated outside the region that is struck directly by the individual streams but can be wetted by the water flowing through the aerator housing, and in that for this purpose, the pins are situated laterally outside the projection of the through-flow holes oriented in the flow direction.

In the housing subregion situated between the flow-dispersing device and the adjacent grid and/or lattice structure, the faucet aerator according to the invention has a plurality of pins that are oriented in the flow direction, spaced apart from one another, and extend over the distance between the flow-dispersing device and the adjacent grid and/or lattice structure. The term "pin" here is understood to mean any projection oriented approximately axially parallel to the flow direction, which can, for example, have a square cross-section or a rectangular or otherwise elongated cross-section, or can also be embodied as a wall section. Since the intent is for these pins to not significantly influence the current of water flowing through, but only after the flow of water is shut off, for them to constitute an evaporation surface that can be wetted by the water flowing through, the pins are thus situated laterally outside the projection of the through-flow holes of the flow-dispersing device, which are oriented in the flow direction. This arrangement of the pins in the housing interior of the aerator housing results in the fact that the pins are not struck directly by the individual streams, but instead, outside the subregion that is struck by the flow of the individual steams, function merely as an evaporation surface without a jet-forming function. These comparatively long pins or struts around which the flowing water circulates are covered by an enveloping water film even after the water valve is closed, resulting in an increased humidity and therefore a reduced evaporation in the housing interior of the aerator housing. It is particularly necessary to prevent an evaporation-induced scale formation in the small dispersing bores of the flow-dispersing device situated at the inflow end because otherwise, this results in a low-quality spray pattern and an insufficient ventilation of the water flowing through. The water pressure acting on faucet aerators of this kind is insufficient to break up such scale deposits and rinse them out of these small dispersing bores. Similar to the function of a "sacrificial anode" in the electrical engineering field, the pins provided according to the invention now constitute an evaporation surface that prevents an evaporation-induced scale formation in the vicinity of the small dispersing bores of the flow-dispersing device situated at the upstream end in the flow direction. Since this prevents a complete drying-out of the interior of the aerator housing in the times between water uses, thus preventing undesirable scale deposits on the housing interior of the aerator housing, the faucet aerator according to the invention is characterized by a high degree of functional reliability even over a long period of time.

Since the function of the pins provided in the faucet aerator according to the invention is not primarily a jet-forming one, it is useful if instead, the individual streams issuing from the flow-dispersing device each directly strike a respective intersecting node of the struts of the grid and/or lattice structure that cross one another at intersecting nodes and if for this purpose, the projections of at least more than half of the through-flow holes oriented in the flow direction are each aimed at a respective intersecting node.

So that the pins each constitute a relatively large surface that can be wetted by the water flowing through, it is advantageous if the ratio of the height h of the pins to the diagonal d—particularly at the base of the pins—is greater than 1.5, particularly greater than 2.0, and especially greater than 2.5.

In a preferred embodiment according to the invention, each pin has a total surface area of greater than 5 $mm^2$, in particular greater than 7 $mm^2$, and especially greater than 9 $mm^2$. This surface area is a measure for the adhesion power that the pins exert on the water.

The pins according to the invention can be secured in any suitable fashion on the housing interior of the aerator housing. For example, these pins can be formed onto the underside or outflow side of the flow-dispersing device. In a preferred embodiment according to the invention, however, the pins are also or alternatively formed onto the outflow side of the flow-dispersing device and/or onto the inflow side of the adjacent grid and/or lattice structure.

In a preferred embodiment according to the invention, the grid and/or lattice structures that constitute the flow-regulating device each have a plurality of struts that are oriented transverse to the flow direction and delimit through-flow openings between themselves.

In one embodiment according to the invention in which the pins are formed solely onto the inflow side of the adjacent grid and/or lattice structure, it can be advantageous if the free ends of the pins point in the direction opposite from the flow direction for the sake of retaining the water, which remains in this housing subregion after the closing of the water valve, for a longer amount of time.

So that each individual pin is able to retain a comparatively large amount of water in the form of a film of water on the surface, it is advantageous if at least one pin has a nonround, preferably polygonal, and especially cruciform pin cross section. In this case, a cruciform pin cross section has the particular advantage that its cross section is adapted particularly well to the grid and/or lattice structure supporting it.

The pins can be clipped, glued, or welded to the struts of the adjacent grid and/or lattice structure or fastened to them in some other way. In a particularly simple and inexpensive-to-produce embodiment according to the invention, however, the pins are formed integrally onto the struts supporting them.

The struts forming a grid or lattice structure and the pins attached to them constitute a particularly advantageous functional unit if the struts supporting the pins form a through-flow plane oriented transversely and preferably at right angles to the flow direction.

In a preferred embodiment according to the invention, the struts supporting the pins are arranged in a grid- or lattice-like fashion in relation to one another, intersecting with one another at intersecting nodes.

In a particularly preferred embodiment according to the invention, the struts supporting the pins form the through-flow plane at the inflow end of the flow-regulating device and are preferably situated immediately downstream of a flow-dispersing device in the flow direction.

So that the flow-regulating device is able to achieve a particularly favorable mixing of air into the individual streams issuing from the flow-dispersing device, it is advantageous if the flow-regulating device has a plurality of insert pieces that are embodied as grid- or lattice-like and have struts that intersect with one another at intersecting nodes.

In a preferred embodiment according to the invention, the preferably aerated faucet aerator has a flow-dispersing device at its inflow end and a flow-regulating device connected downstream of the latter and optionally, a flow straightener is connected downstream of the flow-regulating device.

So that the air flowing into the housing interior is able to easily pass through the rows of pins and as a result, the air drawn in by the faucet aerator can be evenly distributed over the entire cross section of the aerator housing, it is useful if a plurality of rows of parallel pins is provided and if, in comparison to the pins of the inner pin rows, the pins of the outer pin rows preferably have a shorter longitudinal span and/or a greater spacing from one another.

The invention will be explained in detail below in conjunction with a preferred exemplary embodiment. Other defining characteristics according to the invention ensue from the subsequent drawings considered in connection with the claims and the description.

DETAILED DESCRIPTION

Figures 1, 2, 3, 4, 5, 6:
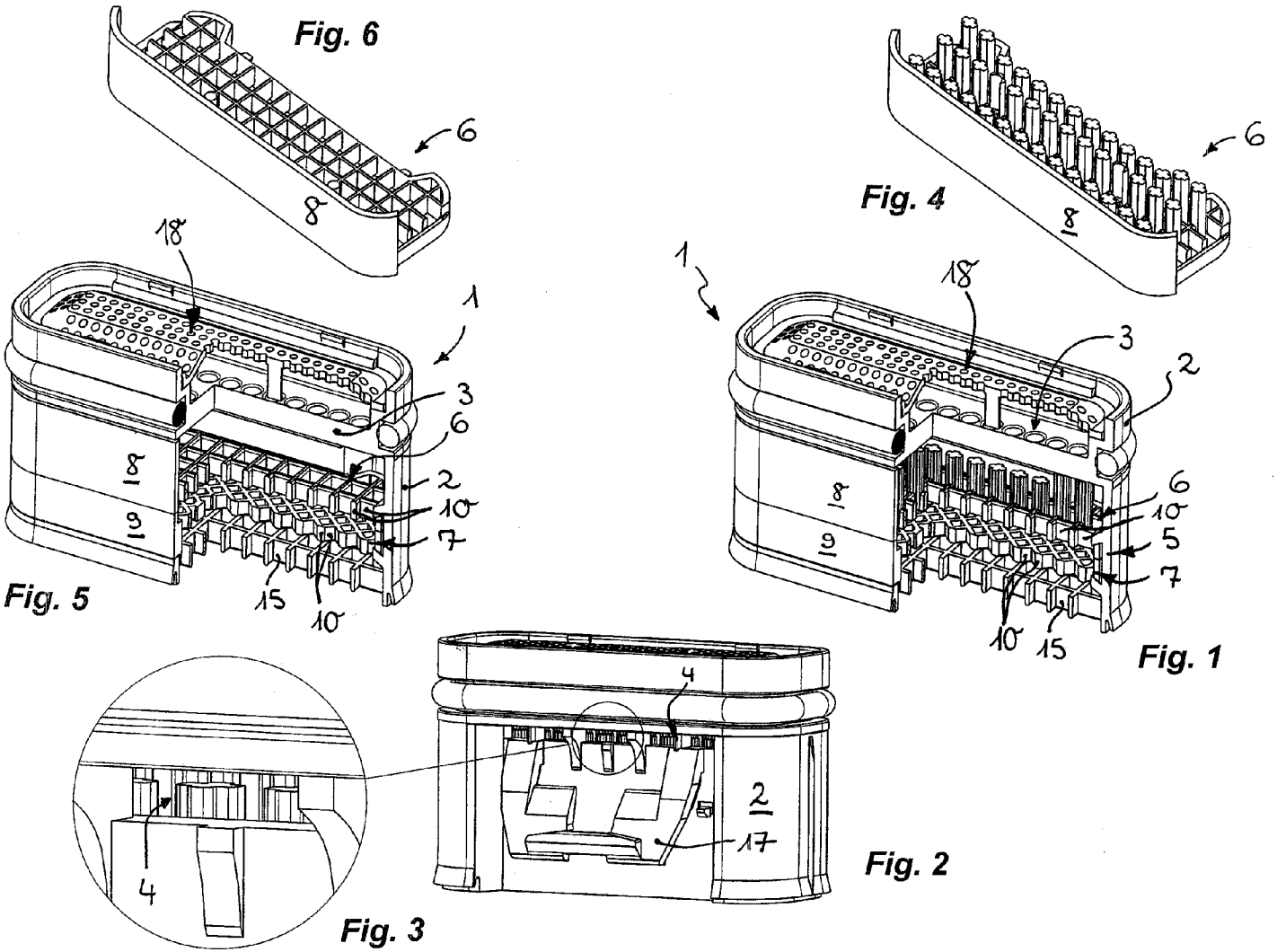
FIG. 1 shows a nonround faucet aerator, whose aerator housing, depicted in a partially cutaway longitudinally sectional view, has a flow-dispersing device at its inflow end embodied in the form of a perforated plate, which is followed by a flow-regulating device that is spaced apart from it in the flow direction and, downstream of the latter, a flow straightener; the flow-regulating device has two insert pieces that are each embodied as a respective grid structure and can be slid in drawer fashion laterally into the aerator housing from the housing circumference.
FIG. 2 is a perspective side view of the faucet aerator from FIG. 1, showing a ventilation opening situated in the housing wall, through which air can be drawn into the housing interior.
FIG. 3 is an enlarged detail view of the ventilation opening from FIG. 2, in which the ventilation opening reveals the housing interior.
FIG. 4 shows the grid structure, which is adjacent to the flow-dispersing device and belongs to the flow-regulating device associated with the faucet aerator from FIGS. 1 through 3; on its inflow side, this grid structure supports pins that are oriented in the flow direction and are axially parallel to one another.
FIG. 5 shows the faucet aerator from FIGS. 1 through 4, with a different grid structure that is embodied alternatively to the one in FIG. 4, without the pins situated thereon; the drawer-like grid structures in FIGS. 4 and 5 can be interchanged with each other as needed.
FIG. 6 shows the grid structure from FIG. 5 that is embodied alternatively to the one in FIG. 4.
Figure 9:
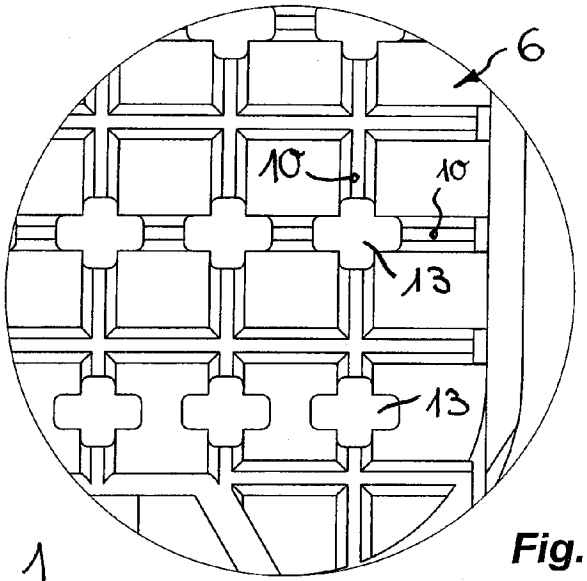
FIG. 9 is a top view of the grid structure from FIGS. 4 and 8, on its inflow side that supports the pins.

FIGS. 1 through 17 show a faucet aerator 1 that can be inserted into the water outlet of a sanitary outflow fixture, not shown in detail here, in order to form a homogeneous, non-spattering, and bubble-softened aerated flow of water. The faucet aerator 1 has an aerator housing 2 that has a nonround housing cross section with a greater housing width in comparison to the housing depth. This cross-sectionally rectangular aerator housing 2 can dispense a likewise rectangular ribbon of water.

On the inflow side of the aerator housing 2, on the housing interior, a flow-dispersing device 3 is provided, which is embodied here in the form of a perforated plate provided with through-flow holes 30 and divides the incoming water into a multitude of individual streams. In this case, on the outflow side of the flow-dispersing device 3, a negative pressure is produced, which exerts a suction on the ambient air. This ambient air—which can enter the housing interior through the ventilation opening 4 provided on the housing circumference and shown in more detail in FIGS. 2 and 3—is mixed into the individual streams.

To that end, downstream of the flow-dispersing device 3 and spaced apart from it in the flow direction, a flow-regulating device 5 is provided, which in this case includes at least two grid structures 6, 7 situated one after the other. These grid structures 6, 7 are embodied here in drawer-like fashion and can be slid laterally into a corresponding housing opening from the housing circumference. Each of the grid structures 6, 7 has a subregion 8, 9 of the housing circumference wall formed onto it so that in the utilization position shown in FIGS. 1 and 7, these wall subregions 8, 9 close the housing opening. Of these grid structures 6, 7, only the upper grid structure 6 is shown in FIGS. 11 through 17.

The grid structures 6, 7 associated with the flow-regulating device 5 have a plurality of struts 10 that are oriented transverse to the flow direction and define through-flow openings between themselves. The struts 10 here are arranged in a grid-like structure in relation to one another, intersecting with one another at intersecting nodes 11.

Figure 7:
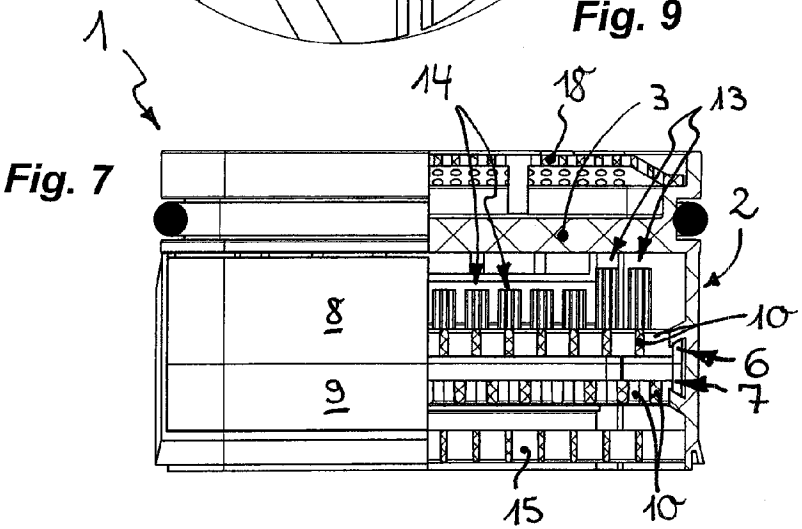
FIG. 7 shows the faucet aerator from FIGS. 1 through 4, in a partially cutaway longitudinally sectional view.
Figure 10:
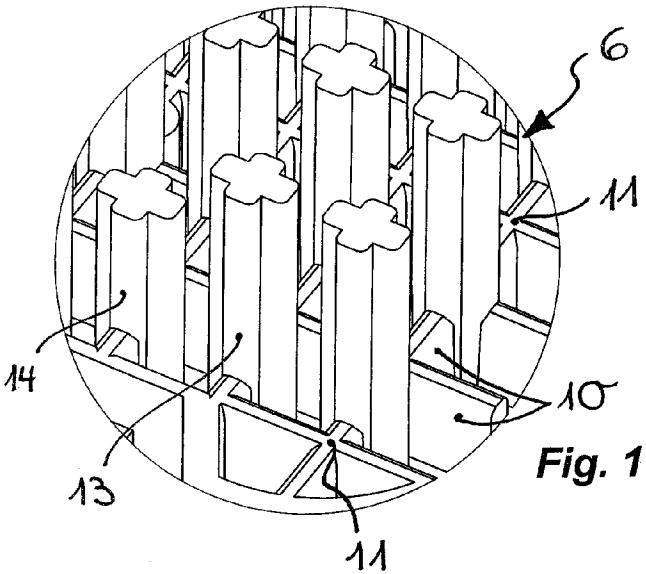
FIG. 10 is a perspective detail view of the approximately axially parallel pins of the grid structure shown in FIG. 9.
Figure 8:
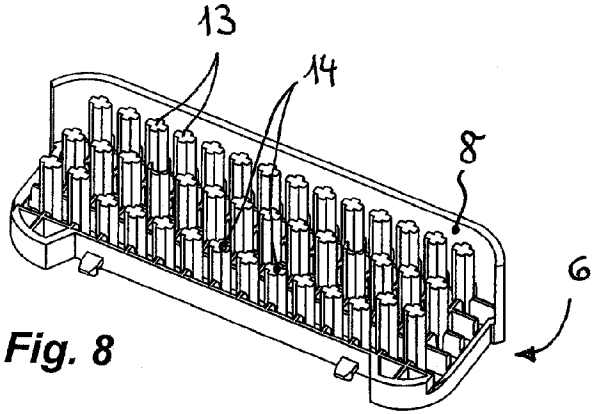
FIG. 8 shows the drawer-like grid structure from FIG. 4, in a perspective view that is rotated by 180°.
Figure 11:
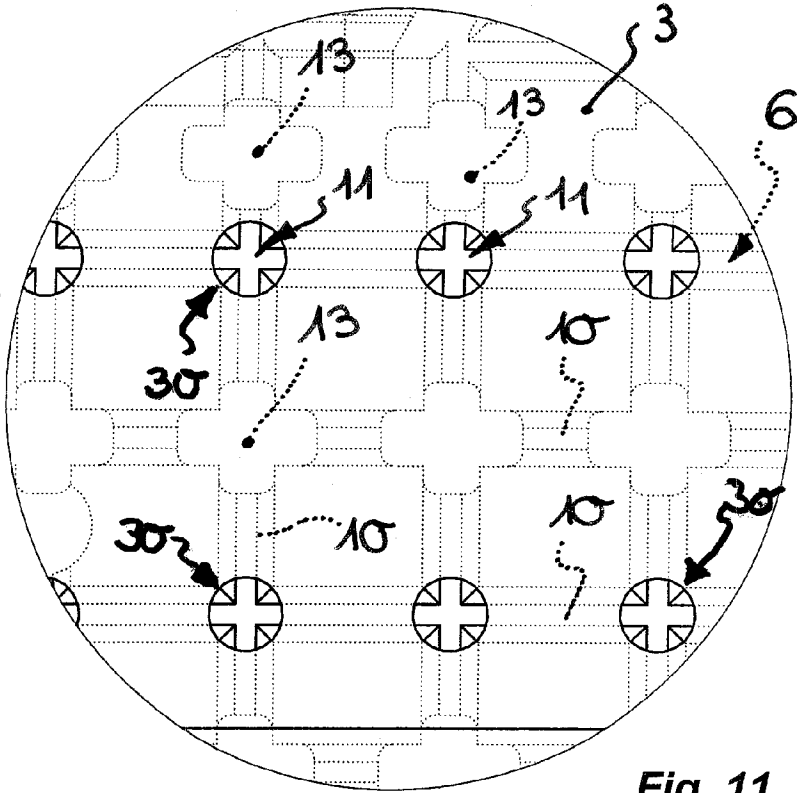
FIG. 11 is a front view of the inflow side of the flow-dispersing device, which is embodied here in the form of a perforated plate; an intersecting node of the subsequent grid structure is visible through each of the through-flow openings of the flow-dispersing device, in the projection oriented in the flow direction.
Figure 12:
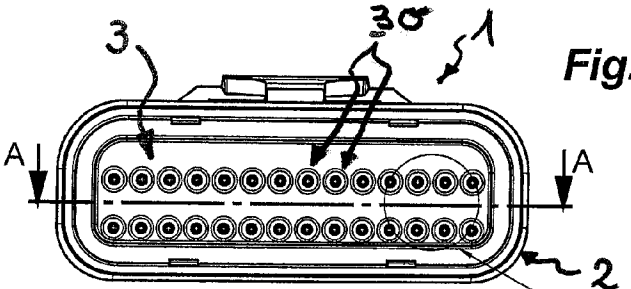
FIG. 12 shows the inflow-side front view of the faucet aerator shown in FIGS. 1 through 11, with the detail already shown in FIG. 11 circled.

In FIGS. 1 and 7, it is clear that in the housing space or housing section situated between the flow-dispersing device 3 and the adjacent grid structure 6, there are a plurality of pins 13, 14 that are oriented approximately axially parallel to one another in the flow direction, spaced apart from one another, and extend largely over the distance between the flow-dispersing device 3 and the adjacent grid structure 6.

In the housing section situated between the flow-dispersing device 3 and the adjacent grid structure 6, the faucet aerator 1 depicted here has a plurality of pins 13, 14, which are oriented in the flow direction, spaced apart from one another, and extend over the distance between the flow-dispersing device 3 and the adjacent grid structure 6. These pins 13, 14 each constitute an evaporation surface, which is situated outside the region that is struck directly by the individual streams but can be wetted by the water flowing through the aerator housing 2. Considered in an overview, in particular in FIGS. 11 through 17, it is clear that for this purpose, the pins 13, 14 are situated laterally outside the projection of the through-flow holes oriented in the flow direction. Essentially, the pins 13, 14 should not affect the current of water flowing through, but only after the inlet valve is closed and the flow of water is shut off, constitute an evaporation surface that can be wetted by the water flowing through. Since the pins 13, 14 do not perform a primarily jet-forming function, the individual streams issuing from the flow-dispersing device 3 can instead each be directed at a respective intersecting node 11 of the struts 10 of the subsequent grid or lattice structure intersecting one another at intersecting nodes 11, in order to be able to effectively decelerate, divide, and mix air into these individual streams.

Figure 13:
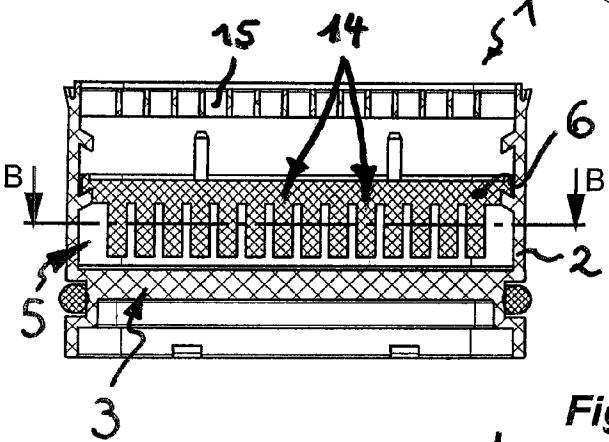
FIG. 13 shows the faucet aerator from FIGS. 11 and 12, in a longitudinal section along the cutting plane A-A indicated in FIG. 12.
Figure 14:
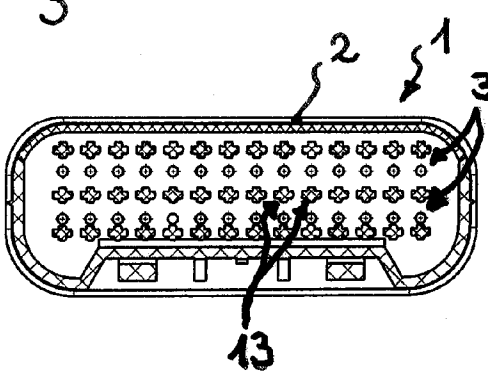
FIG. 14 shows the faucet aerator from FIGS. 11 through 13, in a cross section along the cutting plane B-B indicated in FIG. 13, revealing a front view of the outflow side of the flow-dispersing device.
Figure 15:
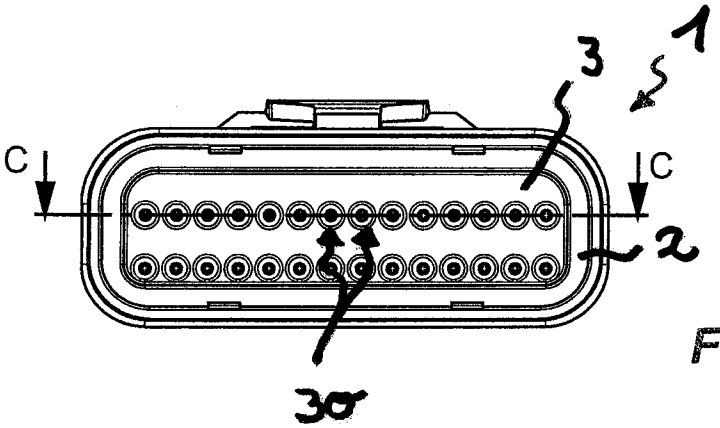
FIG. 15 shows the faucet aerator from FIGS. 11 through 14, in a front view comparable to the one shown in FIG. 11.
Figure 16:
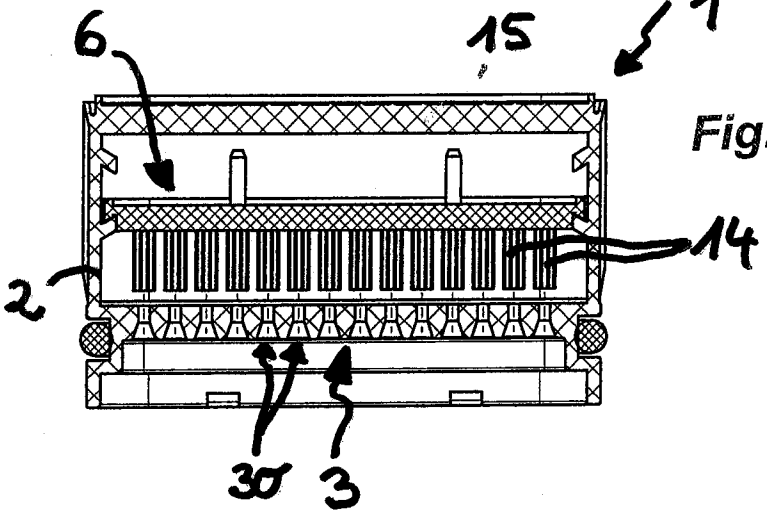
FIG. 16 shows the faucet aerator from FIGS. 11 through 15, in a longitudinal section along the cutting plane C-C indicated in FIG. 15.

It is clear from FIGS. 11 through 14 that the pins 13, 14, which are embodied as cruciform here, are situated laterally outside the projection of the through-flow holes 30 oriented in the flow direction. The intersecting nodes 11 of the grid structure 6, which is situated downstream in the flow direction and supports the pins 13, 14, are visible in the projection of the through-flow holes 30 and are therefore situated beneath these through-flow holes 30. The pins 13, 14 are spaced significantly apart from this projection of the through-flow holes 30 oriented in the flow direction. In the longitudinal section shown in FIG. 13, which extends along the cutting plane A-A indicated in FIG. 12, it is clear that even in a longitudinal section through the pins 13, 14 in the perforated plate of the flow-dispersing device 3, none of the through-flow holes 30 is visible, whereas in the longitudinal section depicted in FIG. 16, which extends through the through-flow holes 30 of the flow-dispersing device 3, the pins 13, 14 situated beneath the flow-dispersing device are clearly visible in a non-sectional view. Furthermore, the positioning of the pins 13, 14 in relation to the flow-dispersing device 3 and its through-flow holes 30 is visible in the cross section shown in FIG. 14, which extends along the cutting plane B-B indicated in FIG. 13, showing a cross section at the level of the pins 13, 14, but looking at the through-flow holes 30 from below. The sectionally depicted, cruciform pins and the through-flow holes 30 situated next to or above them are clearly depicted in the cross section according to FIG. 14.

Figure 17:
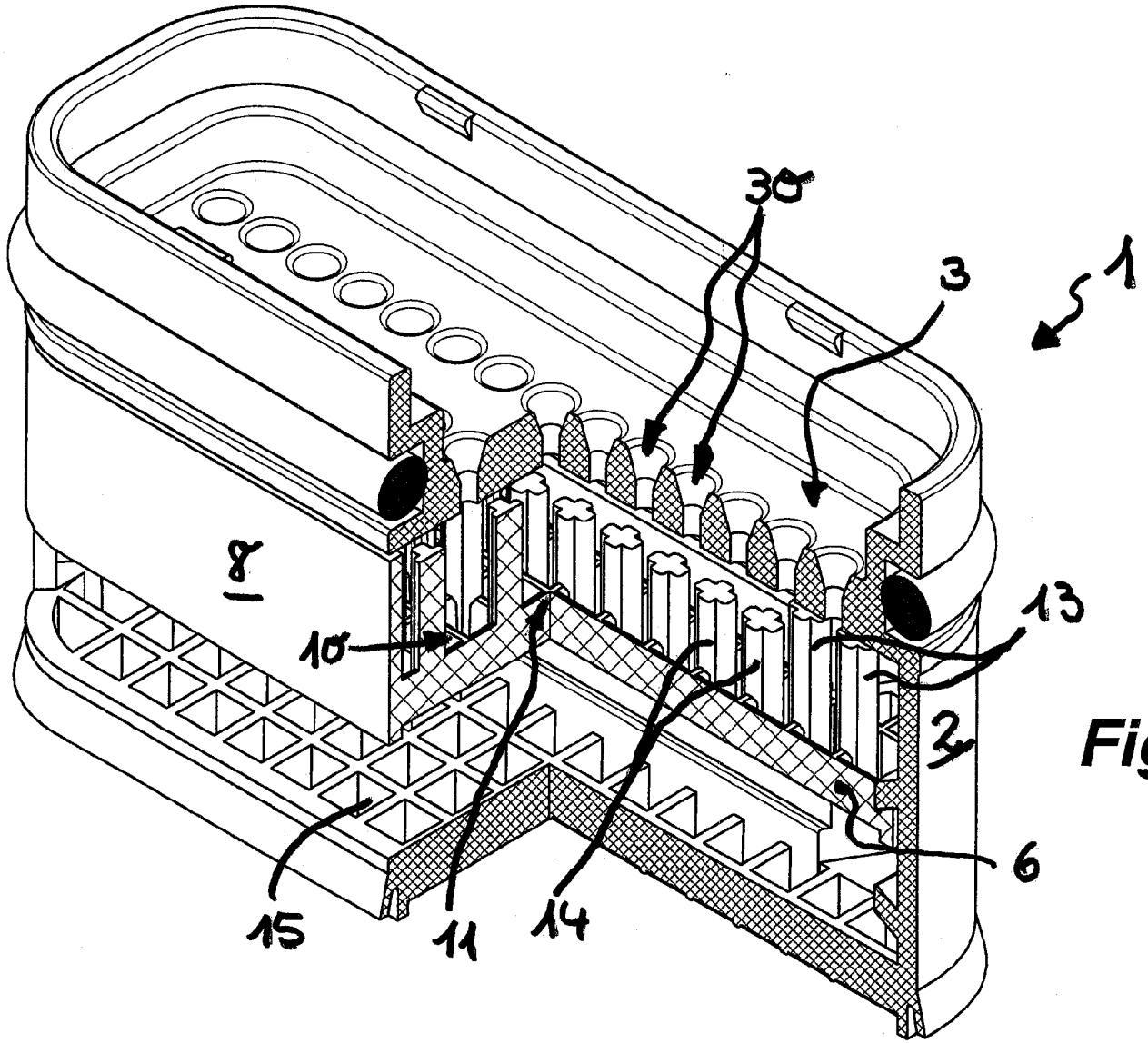
FIG. 17 shows the faucet aerator from FIGS. 11 through 16, in a perspective, partially cutaway longitudinal section.

FIG. 17 shows the faucet aerator 1 in a perspective, partially cutaway depiction. These comparatively long pins 13, 14 around which the water flowing through circulates are covered with an enveloping water film even after the water valve is closed, which results in an increased humidity and therefore a reduced evaporation in the housing interior of the aerator housing 2. Since this prevents a complete drying-out of the interior of the aerator housing 2 in the times between water uses, thus counteracting the formation of undesirable scale deposits on the housing interior of the aerator housing 2 and in the small flow-dispersing bores of the flow-dispersing device, the faucet aerator 1 depicted here is characterized by a high degree of functional reliability, even over a long period of time.

The pins 13, 14 could be formed onto the outflow side of the flow-dispersing device 3 and in this case, are secured to the inflow side of the adjacent grid structure 6. The grid structures 6, 7 and the grid structure 15—which is situated downstream of the flow-regulating device 5, constitutes the outflow side of the aerator housing, and serves as a flow straightener—are each formed by two respective sets of struts oriented transverse to the flow direction, parallel to and crossing one another, which delimit through-flow openings between themselves. As is clearly visible in FIGS. 9 and 10, the pins 13, 14 are situated on the struts 10 of the grid structure 6 adjacent to the flow-dispersing device 3.

FIGS. 1 and 7 clearly show that the pins 13, 14 point with their free pin ends in the direction opposite from the flow direction. In order to provide the largest possible surface area that can be wetted by a water film, the pins 13, 14 have a nonround, in particular polygonal pin cross section. In this case the pins have a cruciform pin cross section, which—as shown in the top view in FIG. 9—corresponds to the facing surface area of the intersecting nodes 11 of the struts 10 supporting them.

The pins 13, 14 here are formed integrally onto the struts 10 of the adjacent grid structure 6 supporting them. The struts supporting the pins 13, 14 form a through-flow plane oriented transversely and preferably at right angles to the flow direction and are arranged in grid-like fashion to one another, intersecting with one another at intersecting nodes 11. The struts 10 of the adjacent grid structure 6 form a through-flow plane at the inflow end of the flow-regulating device 5, which is connected directly downstream of the flow-dispersing device 3 in the flow direction. FIGS. 1, 4, 7, 8, and 10 clearly show that a plurality of rows of parallel pins 13, 14 is provided and that in comparison to the pins 14 of the inner pin rows, the pins 13 of the outer pin rows have a greater longitudinal span. FIGS. 2 and 3 clearly show that the comparatively short pins 14 of the inner pin rows remain clear of the plane that is encompassed by a ventilation opening 4 at the circumference. The air drawn in through the ventilation opening 4 can thus be evenly distributed over the entire cross section of the aerator housing and on the housing interior, can be mixed with the individual streams issuing from the flow-dispersing device 3.

FIG. 2 clearly shows that the aerator housing 2 of the faucet aerator 1 can be slid into the water outlet of a sanitary outflow fixture from the end surface of the outlet. On the housing circumference of the aerator housing 2, a resilient detent projection 17 is provided, which cooperates with a counterpart detent means on the inner circumference of the water outlet.

It is clear from a comparison of FIGS. 1 and 4 on the one hand and FIGS. 5 and 6 on the other hand that the faucet aerator 1 shown here is constructed in modular fashion and that the faucet aerator 1 can be associated with a plurality of grid structures 6 and/or 7 that are embodied in drawer-like fashion. These grid structures 6, which can be interchanged with one another, make it possible to adapt the properties of the faucet aerator shown here to each specific intended use.

FIGS. 1, 5, and 7 show with particular clarity that the faucet aerator 1 has a preliminary lattice 18, which is detachably secured to the housing end surface at the inflow end of its aerator housing 2. This preliminary lattice 18 separates out dirt particles, which may be carried along by the incoming water and could potentially impair the function of the faucet aerator 1 depicted here.

Figure 18:
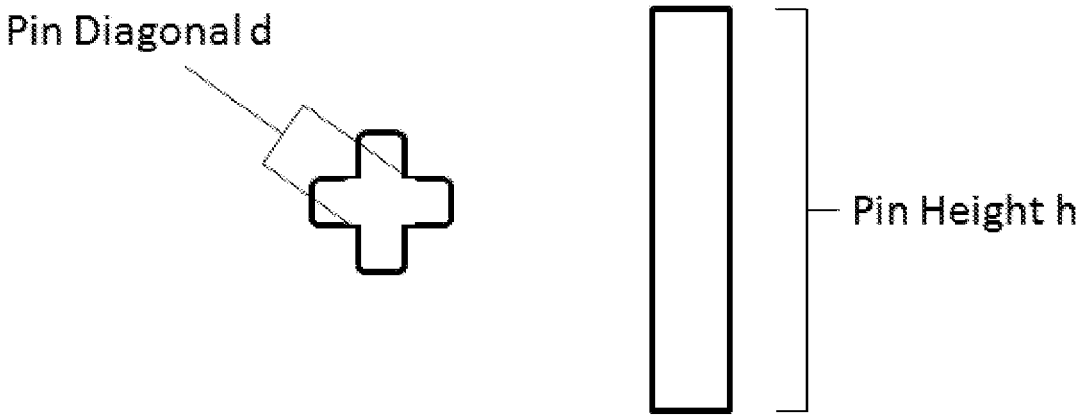
FIG. 18 is a block diagram showing a ratio of the height h of the pins to the diagonal d.

FIG. 18 is a block diagram showing a ratio of the height h of the pins to the diagonal d. This ratio can be greater than 1.5, particularly greater than 2.0, and especially greater than 2.5.

The invention claimed is:

1. A faucet aerator, comprising:

an aerator housing with a housing interior containing a flow-dispersing device with a plurality of through-flow holes that disperse an incoming flow of water into a corresponding number of individual streams;

at least one grid and/or lattice structure spaced apart from the flow-dispensing device in a direction of the incoming flow of water;

a plurality of pins in a housing subregion situated between the flow-dispersing device and the grid and/or lattice structure, the plurality of pins are oriented in the direction of the incoming flow of water, spaced apart from one another, and extend essentially over a distance between the flow-dispersing device and the at least one grid and/or lattice structure, wherein the plurality of pins each have an evaporation surface situated outside a region that is struck directly by the individual streams but can be wetted by the water flowing through the aerator housing, the plurality of pins are situated laterally outside a projection of the through-flow holes oriented in the a direction of the incoming flow of water, wherein the plurality of pins are formed onto an outflow side of the flow-dispersing device or onto an inflow side of the grid and/or lattice structure.

2. The faucet aerator as recited in claim 1, wherein the grid and/or lattice structure includes struts that intersect one another at intersecting nodes, the individual streams issuing from the flow-dispersing device each directly strike a respective intersecting node of the struts and projections of at least more than half of the through-flow holes oriented in the a direction of the incoming flow of water are each aimed at a respective intersecting node.

3. The faucet aerator as recited in claim 1, wherein a ratio of height h to diagonal d of the plurality of pins is greater than 1.5.

4. The faucet aerator as recited in claim 1, wherein each of the plurality of pins has a total surface area of greater than 5 $mm^2$.

5. The faucet aerator as recited in claim 1, wherein the at least one grid and/or lattice structure has a plurality of struts oriented transverse to the a direction of the incoming flow of water and delimit the through-flow openings between themselves.

6. The faucet aerator as recited claim 1, wherein free ends of the plurality of pins point in a direction opposite from the a direction of the incoming flow of water.

7. The faucet aerator as recited in claim 1, wherein at least one of the plurality of pins has a nonround cross section.

8. The faucet aerator as recited in claim 7, wherein at least one of the plurality of pins has a polygonal cross section.

9. The faucet aerator as recited in claim 8, wherein at least one of the plurality of pins has a cruciform pin cross section.

10. The faucet aerator as recited in claim 1, wherein the plurality of pins are formed integrally onto struts of the at least one grid and/or lattice structure, and the struts support the plurality of pins.

11. The faucet aerator as recited in claim 10, wherein the struts form a through-flow plane oriented transversely, at right angles to the a direction of the incoming flow of water.

12. The faucet aerator as recited in claim 10, wherein the struts are arranged in a grid- or lattice-like fashion in relation to one another, intersecting with one another at intersecting nodes.

13. The faucet aerator as recited in claim 10, wherein the struts supporting the plurality of pins form the through-flow plane at an inflow end of a flow-regulating device and are connected immediately downstream of the flow-dispersing device in the a direction of the incoming flow of water.

14. The faucet aerator as recited in claim 13, wherein the flow-regulating device has a plurality of insert pieces that are embodied as grid- or lattice-like and have struts that intersect with one another at intersecting nodes.

15. The faucet aerator as recited in claim 1, wherein the faucet aerator has a flow-dispersing device at its inflow end and a flow-regulating device connected downstream of the flow-dispersing device, and a flow straightener situated downstream of the flow-regulating device.

16. The faucet aerator as recited in claim 1, wherein the plurality of pins are arranged in a plurality of parallel rows, and pins of outer pin rows of the plurality of parallel rows have a greater longitudinal span than pins of inner pin rows of the plurality of parallel rows.

17. The faucet aerator as recited in claim 1, wherein the plurality of pins are arranged in a plurality of parallel rows, and pins of outer pin rows of the plurality of parallel rows have a greater spacing between one another than pins of inner pin rows of the plurality of parallel rows.

* * * * *